US007973003B2

(12) United States Patent
Peltz et al.

(10) Patent No.: US 7,973,003 B2
(45) Date of Patent: Jul. 5, 2011

(54) LAUNDRY STAIN AND SOIL PRETREATMENT SHEET

(75) Inventors: Jamie B. Peltz, Orange Village, OH (US); Robert F. Golownia, Hudson, OH (US)

(73) Assignee: Dirty Laundry, LLC, Cleveland, OH (US)

( * ) Notice: Subject to any disclaimer, the term of this patent is extended or adjusted under 35 U.S.C. 154(b) by 0 days.

(21) Appl. No.: 12/545,644

(22) Filed: Aug. 21, 2009

(65) Prior Publication Data

US 2010/0050344 A1 Mar. 4, 2010

Related U.S. Application Data

(60) Provisional application No. 61/092,500, filed on Aug. 28, 2008.

(51) Int. Cl.
*C11D 17/04* (2006.01)
*C11D 3/386* (2006.01)
*C11D 1/722* (2006.01)

(52) U.S. Cl. ..... 510/296; 510/276; 510/281; 510/283; 510/320; 510/336; 510/356; 510/403; 510/404; 510/438; 510/439

(58) Field of Classification Search ..... 510/276, 510/281, 283, 404, 438, 439, 296, 320, 336, 510/356, 403
See application file for complete search history.

(56) References Cited

U.S. PATENT DOCUMENTS 3,645,390 A * 2/1972 Ryan ..... 206/568
3,953,353 A 4/1976 Barrett, Jr. et al.
4,199,482 A 4/1980 Renaud et al.
4,285,841 A 8/1981 Barrat et al.
4,348,293 A 9/1982 Clarke et al.
4,515,703 A * 5/1985 Haq ..... 15/104.93
4,595,527 A 6/1986 Gipp
4,711,739 A 12/1987 Kandathil
4,720,351 A 1/1988 Flynn et al.
4,842,762 A 6/1989 Sabol, Jr. et al.
4,973,416 A 11/1990 Kennedy
5,186,856 A 2/1993 Holland
5,288,420 A 2/1994 Mandy
5,384,060 A 1/1995 Mandy et al.
5,447,649 A 9/1995 Gormsen
5,648,326 A 7/1997 Sramek
5,747,442 A 5/1998 Bory et al.
5,780,047 A * 7/1998 Kamiya et al. ..... 424/443
5,783,541 A 7/1998 Tack et al.
5,820,637 A 10/1998 Bory et al.
5,916,674 A * 6/1999 Skelly et al. ..... 428/336
6,037,319 A 3/2000 Dickler et al.
6,077,317 A 6/2000 Murphy
6,124,036 A 9/2000 Brown et al.

(Continued)

FOREIGN PATENT DOCUMENTS

EP 0 011 502 A1 5/1980

(Continued)

*Primary Examiner* — Lorna M Douyon

(74) *Attorney, Agent, or Firm* — Pearne & Gordon LLP

(57) ABSTRACT

A laundry stain and soil pretreatment sheet including a water soluble or water dispersible carrier layer, preferably polyvinyl alcohol, a removable separator layer, and a layer of cleaning agent composition therebetween. The separator layer is removed, the composition layer is adhered to a stain on clothing, and the clothing is laundered to treat the stain. The carrier layer dissolves or disperses during the laundering.

30 Claims, 1 Drawing Sheet

U.S. PATENT DOCUMENTS

| | | | | |
|---|---|---|---|---|
| 6,465,407 | B2 * | 10/2002 | Hayashi et al. | 510/295 |
| 6,576,604 | B1 * | 6/2003 | Hoshino et al. | 510/438 |
| 6,699,826 | B1 * | 3/2004 | Saijo et al. | 510/296 |
| 6,812,199 | B2 | 11/2004 | Dasque et al. | |
| 7,094,744 | B1 * | 8/2006 | Kobayashi et al. | 510/296 |
| 2004/0072709 | A1 | 4/2004 | Wiedemann et al. | |
| 2004/0204334 | A1 * | 10/2004 | Terada et al. | 510/438 |
| 2004/0266650 | A1 | 12/2004 | Lambotte et al. | |
| 2005/0019277 | A1 * | 1/2005 | Sagel et al. | 424/53 |
| 2007/0213246 | A1 | 9/2007 | Wiedemann et al. | |

FOREIGN PATENT DOCUMENTS

| | | | |
|---|---|---|---|
| EP | 0 253 566 | A2 | 1/1988 |
| WO | 02/32780 | A2 | 4/2002 |

* cited by examiner

LAUNDRY STAIN AND SOIL PRETREATMENT SHEET

This application claims the benefit of U.S. Provisional Application No. 60/092,500 filed on Aug. 28, 2008.

FIELD OF THE INVENTION

The invention relates to laundry stain and soil pretreatments, also called laundry prespotters, and to pretreatments which are in the form of thin self-adherent flexible sheets which can be easily applied to stained and/or soiled areas of clothing using direct finger pressure much like that used to apply adhesive tape, postage stamps, labels, decorative stickers, etc.

BACKGROUND OF THE INVENTION

Liquid and semisolid compositions containing detergents and other cleaning components used as pretreatments for the stained and soiled areas of clothing prior to laundering have been available in the marketplace for many years. Examples of liquid pretreatments are described in U.S. Pat. Nos. 6,077,317 and 4,595,527. Examples of semisolid pretreatment sticks are described in U.S. Pat. Nos. 4,842,762, 5,384,060 and 5,747,442. Such pretreatments, applied to stains prior to laundering, provide extra cleaning action to a stained area on the clothing when the treated clothing is subsequently laundered in a conventional manner. The extra cleaning action provided by the invented pretreatment sheet is intended to be similar or comparable to various pretreatment products currently available in the marketplace as exemplified by "SPRAY'n WASH Stain Stick" sold by Reckitt Benckiser, Inc., Parsippany, N.J. 07054, "SHOUT LAUNDRY STAIN REMOVER" sold by S.C. Johnson & Son, Inc., Racine, Wis. 53403 and "Zout Laundry Stain Remover" sold by The Dial Corporation, Scottsdale, Ariz. which are intended to treat stains from food, oil, grass, etc. prior to laundering. The skin and eye irritation properties of laundry pretreatments are well known and are clearly acknowledged on the package labels of the widely available "SPRAY'n WASH Stain Stick", "SHOUT LAUNDRY STAIN REMOVER" and "Zout Laundry Stain Remover" pretreatment products mentioned above.

Prior art pretreatments are applied directly to stained clothing fabric by spraying liquid pretreatments or by rubbing paste or semisolid pretreatments in stick form onto the stained areas of the fabric. In the case of spray-applied liquid pretreatments, it is difficult to consistently spray an amount of liquid pretreatment just sufficient to saturate the stained areas because fabric types, depending on their thickness, weave and fiber composition (cotton, nylon, polyester, etc.) vary considerably in their ability to absorb liquids. Consequently, it is not unusual that excess liquid is sprayed onto the stain which forms pools, drips and runs of the liquid pretreatment that is not only wasteful but also increases the likelihood that the pretreatment liquid will contact and possibly irritate the user's skin during pretreatment application and when handling the pretreated clothing prior to laundering.

In the case of semisolid pretreatment sticks, the amount of pretreatment composition applied to the stained fabric will be variable because the amount of pressure applied during the application process naturally varies from person to person according to their physical strength and with their prior experience with the product. Sometimes too little pretreatment will be applied while at other times an excessive amount will be applied. As with liquid pretreatments, excess pretreatment is not only wasteful but also increases the likelihood that pretreatment will contact and possibly irritate the user's skin when handling the treated clothing prior to laundering. The present invention uses a pre-measured, non-wasteful amount of cleaning agent and, due to the inclusion of the water soluble/dispersible carrier layer, reduces the possibility of skin contact with the cleaning agent and resulting skin irritation.

Thus several advantages of the invention are to provide an easy-to-use laundry stain pretreatment sheet which provides a controlled, effective but non-wasteful amount of pretreatment cleaning composition to a stained area on clothing fabric while significantly reducing the potential for the pretreatment composition to contact the skin during pretreatment application and during manual handling of the treated clothing prior to laundering.

SUMMARY OF THE INVENTION

A laundry stain and soil pretreatment sheet comprising a water soluble or water dispersible carrier layer, a removable separator layer, and a layer of cleaning agent composition between said carrier layer and said separator layer. A method of treating a stain on an article of clothing comprises providing a sheet as described above, removing the separator layer, adhering the layer of cleaning agent composition to the stain so that the layer of cleaning agent composition is between the stain and the carrier layer, and laundering the article of clothing, during which the carrier layer dissolves or disperses.

DETAILED DESCRIPTION OF THE PREFERRED EMBODIMENTS OF THE INVENTION

In the description that follows, when a preferred range, such as 5 to 25 (or 5-25), is given, this means preferably at least 5 and, separately and independently, preferably not more than 25. The term paste includes gel. The entire contents of all patents mentioned herein are incorporated herein by reference.

Figure 1:
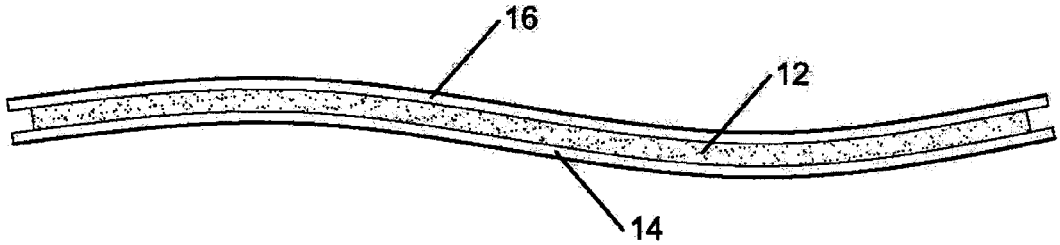
FIG. 1 is a side view of the invented pretreatment sheet showing the relative position of the three layers.

With reference to FIG. 1 there is shown a pretreatment sheet according to the invention comprising a water soluble or water dispersible carrier layer 14, a removable separator layer 16, and a layer of cleaning agent composition 12.

Carrier layer 14 is preferably flexible, such as flexible film or flexible sheet, and is water soluble at water temperatures conventionally used in residential washing machines, both cold water wash and hot water wash; alternatively, carrier layer 14 is water dispersible when used in laundering in a conventional residential washing machine at both cold water wash and hot water wash. Carrier layer 14 is preferably polyvinyl alcohol (PVA) film, less preferably other water soluble films made of or based on water soluble polymers like polyethylene oxide, partially hydrolyzed polyvinyl acetate, hydroxylethyl cellulose, hydroxylpropyl cellulose, methyl cellulose, modified starch, and others known in the art. PVA has good water solubility, good physical strength and low cost. Alternatively, carrier layer 14 can be a water dispersible layer, such as a layer of paper or similar material made of short, water-insoluble non-woven fibers, such as polyester fibers, which are designed to rapidly disintegrate or disperse when immersed in water; examples of these types of products are "Washaway Foundation Paper", W. H. Collins, Inc., Spartanburg, S.C., 29304, "Paper Solvy, Water Soluble Stabilizer", Sulky of America, Port Charlotte, Fla. 33949, and "RinsAway Water Soluble Backing", HTC, Inc., Roseland, N.J., 07068; other polyester fiber-based papers can be used. Carrier layer 14 is preferably 0.001-0.005 inches (0.025-0.13 mm) or 0.002-0.004 inches (0.051-0.1 mm), thick, less preferably 0.001-0.01 or 0.001-0.02 inches (0.025-0.25 or 0.025-0.51 mm) thick. MonoSol M8630 from MonoSol, LLC, Portage, Ind. 46368 is a commercially available PVA film that can be used. Carrier layer 14 is water soluble or water dispersible so it will dissolve/disperse when the stained clothing is laundered and will not clog filters or pipes, etc. In use, carrier layer 14 prevents (a) skin contact with the cleaning agent composition and (b) cleaning agent getting rubbed off or rubbed onto other parts of the fabric after the sheet is applied to the stained clothing and during manual and mechanical handling prior to the clothing being laundered.

Separator layer 16 is used to prevent cleaning agent composition 12 from coming into contact with and adhering to other pretreatment sheets or other things during manufacturing, packaging, handling and storage. Layer 16 is impervious to composition 12 and is easily peeled and released from the surface of composition 12 immediately prior to application of the pretreatment sheet to the stained clothing fabric. Layer 16 is preferably polyethylene film, such as is used to make food storage bags for home use, less preferably other flexible plastic or polymer films (polyester, polyvinyl chloride, etc.). Layer 16 is preferably about 0.001-0.004 inches (0.025-0.1 mm) or 0.003 inches (0.076 mm) thick, less preferably 0.001-0.01 inches (0.025-0.25 mm) thick. Release liners or release strips as known in the art, including those having a silicone release layer, can also be used.

Cleaning agent composition 12 is a composition which is effective to treat or clean stained or soiled clothing or fabric in a manner preferably similar to conventional laundry stain and soil pretreatments or pre-spotters. Cleaning agent composition 12 is preferably flexible and bendable so it can bend or flex with the clothing to which it is stuck. Composition 12 must be sufficiently sticky so that it will effectively adhere to stained or soiled clothing, such as cotton jeans, polyester jeans, clothing made of linen, jersey, khaki, wool, rayon, nylon, cotton blends, polyester blends, etc., during handling prior to washing and during a washing cycle in a residential washing machine, when pressed on with finger pressure. Preferably, composition 12 is sticky enough that, during a wash cycle in a residential washing machine, it will dissolve off of the clothing fabric, rather than fall off. Preferably, composition 12 will adhere to the clothing fabrics mentioned above at least as well as peanut butter, alternatively at least as well as a pad of butter at 40, 45, 50, 55 or 60° F. Composition 12 is preferably a paste, preferably a thick or viscous paste or stiff paste, preferably stiffer than grocery store peanut butter; it can be almost stiff enough that it shows cracks when bent; it can have a stiffness comparable to or less than the stiffness of a pad of butter at 40, 45, 50, 55 or 60° F.

Composition 12 contains surfactants, detergents, enzymes, chelating agents and/or other agents known in the art so that composition 12 can work effectively. In order to form a paste or make it thicker, composition 12 can preferably contain one or more water soluble or water dispersible thickening agents, such as polyethylene oxide, hydroxyethyl cellulose, hydroxypropyl cellulose, fumed silica, natural gums such as guar gum, and others known in the art.

Since carrier layer 14 is water soluble/dispersible, it is preferred to minimize the amount of water in composition 12 to prevent or minimize softening or wrinkling or dissolution of layer 14 during storage. Composition 12 is preferably less than 24, 23, 22, 21, 20, 19, 18, 17, 16, 15, 14, 13, 12, 11, 10, 9, 8, 7, 6, 5, 4, 3, 2, 1, 0.5, 0.3, 0.2, 0.1, or 0.01, weight percent water or unbound water. Some water may need to be added to accommodate added enzymes or other additives or to modify viscosity or for other reasons in composition 12. Water in composition 12 can be minimized or neutralized by being bound or complexed with other molecules; or other agents with an affinity for water can be added, such as alkanolamine, such as monoethanolamine, diethanolamine, triethanolamine and mixtures thereof, to protect layer 14 from water. Any water in composition 12 should be less than an amount which would prevent layer 14 from functioning effectively as a carrier layer. Composition 12 should be essentially water-free, meaning that any water in composition 12 should be less than an amount which would prevent layer 14 from functioning effectively as a carrier layer.

Composition 12 preferably contains at least 50, 55, 60, 65, 70, 75, 80, 85, 90, 91, 92, 93, 94, 95, 96, 97, 98, 99, 99.5 or 100, weight percent surfactant as known in the cleaning art. Composition 12 preferably contains less than 40, 35, 30, 25, 20, 15, 10, 8, 5, 4, 3, 2 or 1, weight percent thickener and preferably less than 10, 9, 8, 7, 6, 5, 4, 3, 2, 1, 0.8, 0.5, 0.3, 0.2, 0.1 or 0.01, weight percent enzyme, but can contain at least 0.01 or 0.1 weight percent thickener or enzyme. Weight percents of components are calculated as received from the supplier, that is, including the water or solvent or carrier that the component is in.

U.S. Pat. Nos. 4,973,416 and 6,037,319 describe liquid cleaning agent compositions which contain up to about 24 weight percent water which can be stored in PVA pouches; these compositions can be used, but they have to be turned into a paste such as by the addition of a thickener and/or the inclusion of solid and/or paste surfactants and/or water soluble waxy solids, for example those surfactants and waxy solids described in U.S. Pat. No. 3,953,353. Examples of useful cleaning agent compositions include, but are not limited to, those described in U.S. Pat. No. 3,953,353, which optionally can be adjusted to make them sticky and a paste. Similar cleaning agent compositions can also be used. Cleaning agent composition 12 is preferably essentially anhydrous. Composition 12 can, for example, contain 0.1-50 or 1-40 or 10-35 or 20-32 or 25-35 wt. % polyethylene oxide or any surfactant, preferably MW 2000-6000 or 3500-4500 g/mol, melting point 45-65 or 50-60° C. Composition 12 preferably contains solid or paste surfactants (such as EO/PO block copolymer) preferably MW of 2000-10000 or 3000-9000 or 4000-7000 or 4000-6000 g/mol. Alternatively, composition 12 can be essentially soap-free.

Preferred surfactants include those mentioned in the Examples herein or in the same class, as well as the same surfactants with as much as ±10% or ±20% as to molecular weight and melting point; they can be present in the same weight percent as in the Examples or up to ±10%, 20%, 30%, 40% or 50% as to weight percent or molecular weight or melting point.

A cleaning agent composition 12 can be prepared by melting together at about 150-200° F. a blend of surfactants, detergents, enzymes, chelating agents, thickeners, etc. and other components, chosen to optimize the melting point, hardness, cleaning efficacy and adhesive properties, and preferably becomes a paste upon cooling to room temperature.

EXAMPLES

The materials listed in Examples below were mixed and melted together while stirring with a metal spatula in a stain-less steel container resting on an electric hotplate which was adjusted to bring the temperature of the melt to approximately 165° F. in about five minutes. The melt was then poured onto a 0.003 inch (0.076 mm) thick film of PVA film (MonoSol M8630 from MonoSol, LLC, Portage, Ind. 46368) resting on a flat horizontal surface. The melt was then immediately spread out onto the PVA film with a single sweeping motion of a warm, 0.025 inches (0.64 mm) thick, steel doctor blade which was spaced above the PVA film by 0.5 inch (12.7 mm) wide by 10 inches (254 mm) long by 0.018 inch (0.46 mm) thick plastic shims resting on the upper surface of the PVA film. When cooled to room temperature, the mixture became a waxy paste which, over time, did not cause softening, wrinkling or puckering of the PVA water soluble layer 14. At this time, a separator layer of 0.001 inch thick polyethylene was placed on the top surface of the cleaning agent composition layer. The cleaning agent composition is preferably 0.1-5 or 0.2-3 or 0.3-2 or 0.3-1 or 0.3-0.6 mm thick on the layer 14. The invented sheet and the layer 14 is preferably provided in small squares, rectangles, circles or other shapes, preferably not more than 1, 2, 3, 4, 5, 6, or 7 inches (25, 51, 76, 102, 127, 152 or 178 mm) in its longest dimension, such as circles not more than 0.5, 1, 2, 3, 4, 5, 6 or 7 inches (13, 25, 51, 76, 102, 127, 152 or 178 mm) in diameter, or squares or rectangles having sides not more than 0.5, 1, 2, 3, 4, 5, 6 or 7 inches (13, 25, 51, 76, 102, 127, 152 or 178 mm) in length. The cleaning agent composition is preferably separated from the edge of the layer 14 by a distance of at least 1, 2, 3, 4, 5, 6, 7, 8, 9, 10, 11, 12, 13, 14 or 15 mm.

hours before laundering in a Whirlpool Model WTW5700W0 home washing machine set for cold water wash and using "2× Ultra Tide" liquid laundry detergent in conventional amount. The test fabrics were laundered and dried in conventional manner. Visual inspection of the laundered and dried test fabrics showed that the stained areas which were treated with the pretreatment sheets of Example 1 were noticeably lighter in color than corresponding stained areas which had no pretreatment sheet applied prior to laundering.

The separator layer 16 is applied with slight pressure to the top surface of the cooled and solidified layer of cleaning agent composition 12 before further processing and packaging of the completed pretreatment sheets. Further processing can include operations like cutting of the sheet into smaller sizes to suit consumer needs, printing of quality control information, logos, directions, etc. onto the exposed surfaces of the layer 14 and/or the separator layer 16. The separator layer may be colored or printed to make it visually obvious to the user that it is to be removed and discarded before application of the cleaning agent-carrier layer combination to the stained clothing fabric.

Figure 2:
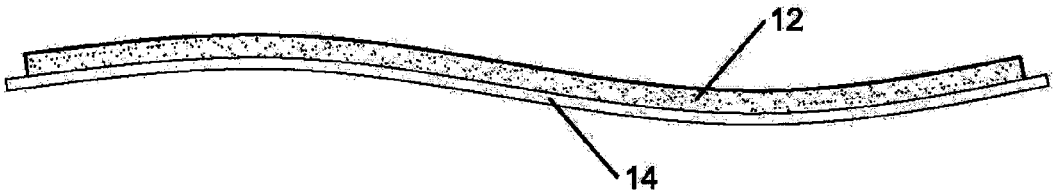
FIG. 2 is a side view of the pretreatment sheet shown in FIG. 1 with the separator layer removed.
Figure 3:
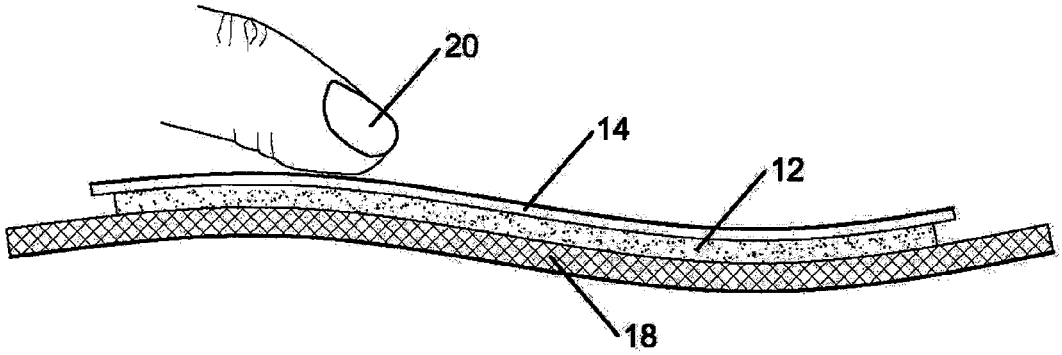
FIG. 3 is a side view of the pretreatment sheet, with the separator layer removed, being adhered to stained fabric using finger pressure applied to the sheet.

In operation one removes a stain pretreatment sheet from the package and, using the fingers, grasps the edge of the separator layer 16 and peels it away from the surface of the cleaning agent composition 12 while holding the edge of the carrier layer between the fingers of the other hand. This process leaves the cleaning agent-carrier layer combination intact as shown in FIG. 2. The cleaning agent-carrier layer combination is then positioned above the stained portion of

EXAMPLES OF CLEANING AGENT COMPOSITIONS

| | Parts by weight |
|---|---|
| Example 1 | |
| Pluriol E-4000* (polyethylene oxide waxy solid, MW = 4,000 g/mol, MP = 55° C.) | 30 |
| Pluronic P-84* (semisolid EO/PO block copolymer surfactant, MW = 4,200 g/mol) | 41 |
| Lutensol TDA-3* (liquid surfactant, tridecyl alcohol + 3 moles ethylene oxide) | 29 |
| Example 2 | |
| Lutensol AT-25* (solid surfactant, stearyl alcohol + 12 moles ethylene oxide) | 30 |
| Pluronic P-84* (semisolid EO/PO block copolymer surfactant, MW = 4,200 g/mol) | 40 |
| Lutensol TDA-3* (liquid surfactant, tridecyl alcohol + 3 moles ethylene oxide) | 30 |
| Example 3 | |
| Pluronic F-87* (solid EO/PO block copolymer surfactant, MW = 7700 g/m) | 29 |
| Pluronic P-84* (semisolid EO/PO block copolymer surfactant, MW = 4,200 g/mol) | 40 |
| Lutensol TDA-3* (nonionic surfactant, tridecyl alcohol + 3 moles ethylene oxide) | 29 |
| Purastar HP Am 5000L** (proprietary aqueous solution of alpha amylase enzyme) | 1 |
| Purafect Prime 4000L** (proprietary aqueous solution of proteolytic enzyme) | 1 |
| Example 4 | |
| Pluronic F-87* (solid EO/PO block copolymer surfactant, MW = 7700 g/m) | 30 |
| Pluronic P-84* (semisolid EO/PO block copolymer surfactant, MW = 4,200 g/mol) | 40 |
| Lutensol TDA-3* (liquid surfactant, tridecyl alcohol + 3 moles ethylene oxide) | 10 |
| Pluronic L-64* (liquid EO/PO block copolymer surfactant, MW = 2900 g/m) | 20 |

*Supplied by BASF Corporation, Mount Olive, NJ 07628
**Supplied by Genencor International, Rochester, NY 14618

Using the process described above, the composition of Example 1 was formed into pretreatment sheets of 19 mm by 19 mm squares which were subsequently applied to 100% cotton knit t-shirt fabric which had been previously stained with dyed (4% ground yellow Annato seed added) vegetable cooking oil, French-style salad dressing and tomato ketchup. Stains were 19 mm diameter circles made by applying 0.1 milliliter of stain material to the fabric and allowing to dry for twelve hours before testing. One pretreatment sheet was applied to each stain and allowed to remain in contact for two the fabric and pressed onto the stain with finger 20 pressure (or it can be pressed with a hand tool such as the end of a pen or a small piece of plastic so as to prevent cleaning agent from contacting the finger 20) with sufficient force to cause the cleaning agent-carrier layer combination to adhere to the stained clothing fabric 18. The invention can be stuck to the stain as soon as the stain is noticed and left in place for one to several days or a week or longer before the fabric is laundered; alternatively it can be stuck on right before the fabric is laundered. Unlike prior art liquid and stain stick type laundry stain pretreatments, the carrier layer of the pretreatment sheet remains adhered to the cleaning agent after application to the stain where it functions as a barrier to prevent contact of the cleaning agent with the skin during pretreatment application and during subsequent manual handling of the pretreated clothing prior to laundering. The pretreated stained fabric can now be laundered by conventional means in home or commercial washing machines. For example, the stained fabric with the invented sheet stuck to it can be put into a washing machine with or without other clothes; a conventional detergent in a conventional amount for all the clothes in the load can be added; water is added; the washing machine agitates the clothes in the water; the water is removed; the clothes are rinsed and then dried. Alternatively, the stained fabric treated with the invention can be laundered in the same manner as stained fabrics pretreated with prior art pretreatments or stain removers are laundered. Because it is adhered directly to the stain, the pretreatment sheet will supply concentrated cleaning action to the stained area during laundering to give a level of stain removal superior to non-pretreated areas of the clothing. Because the carrier layer is water soluble/dispersible, it harmlessly dissipates into the wash water during the laundering process.

Although the herein above described embodiments of the invention constitute the preferred embodiments, it should be understood that modifications can be made thereto without departing from the scope of the invention as set forth in the appended claims.

What is claimed is:

1. A laundry stain and soil pretreatment sheet comprising a water soluble or water dispersible carrier layer, a removable separator layer, and a layer of cleaning agent composition between said carrier layer and said separator layer, wherein said cleaning agent composition is at least 50 weight percent surfactant, and wherein, prior to use, the separator layer adheres to the composition layer by the stickiness of the composition layer and wherein the separator layer is peelable and releasable from the composition layer prior to application of the sheet to a stained or soiled fabric.

2. The sheet of claim 1, wherein said composition is a paste.

3. The sheet of claim 1, wherein said carrier layer is a water soluble film.

4. The sheet of claim 1, wherein said carrier layer is polyvinyl alcohol film.

5. The sheet of claim 1, wherein said separator layer is polyethylene.

6. The sheet of claim 1, wherein said cleaning agent composition is less than 24 weight percent water.

7. The sheet of claim 1, wherein said cleaning agent composition is less than 10 weight percent water.

8. The sheet of claim 1, wherein said layer of cleaning agent composition is 0.1-5 mm thick.

9. The sheet of claim 1, wherein said sheet is not more than 7 inches in its longest dimension.

10. The sheet of claim 1, wherein said separator layer comprises polymer film.

11. The sheet of claim 1, wherein said sheet is a flexible sheet.

12. The sheet of claim 1, wherein said separator layer comprises polyethylene film.

13. The sheet of claim 1, wherein said cleaning agent composition is less than 3 weight percent water.

14. The sheet of claim 1, wherein said cleaning agent composition is essentially water-free.

15. The sheet of claim 1, wherein said cleaning agent composition is at least 85 weight percent surfactant.

16. The sheet of claim 1, wherein said cleaning agent composition comprises enzyme, but comprises less than 10 weight percent enzyme.

17. The sheet of claim 1, wherein said cleaning agent composition is essentially anhydrous.

18. The sheet of claim 1, wherein said cleaning agent composition is at least 10 weight percent polyethylene oxide.

19. The sheet of claim 1, wherein said cleaning agent composition is at least 10 weight percent ethylene oxide/propylene oxide block copolymer.

20. The sheet of claim 1, wherein said layer of cleaning agent composition is 0.2-3 mm thick.

21. The sheet of claim 1, wherein said sheet is not more than 3 inches in its longest dimension.

22. The sheet of claim 1, wherein the carrier layer adheres to the composition layer.

23. The sheet of claim 1, wherein the carrier layer adheres to the composition layer by the stickiness of the composition layer.

24. The sheet of claim 1, wherein the composition layer is sufficiently sticky so that it will effectively adhere to a stained or soiled fabric when pressed on with finger pressure.

25. The sheet of claim 1, wherein said composition is a gel.

26. The sheet of claim 1, wherein said carrier layer is a water dispersible layer.

27. The sheet of claim 1, wherein said sheet has a shape of a rectangle or a circle.

28. The sheet of claim 1, wherein the carrier layer has a shape of a rectangle or a circle.

29. The sheet of claim 1, wherein the carrier layer is not more than 7 inches in its longest dimension.

30. The sheet of claim 1, wherein the carrier layer is not more than 3 inches in its longest dimension.

* * * * *

UNITED STATES PATENT AND TRADEMARK OFFICE

CERTIFICATE OF CORRECTION

PATENT NO. : 7,973,003 B2
APPLICATION NO. : 12/545644
DATED : July 5, 2011
INVENTOR(S) : Jamie B. Peltz et al.

It is certified that error appears in the above-identified patent and that said Letters Patent is hereby corrected as shown below:

At column 1, line 5, after "No." and before "filed" please delete "60/092,500" and insert therefor --61/092,500--.

Signed and Sealed this
Twentieth Day of September, 2011

David J. Kappos

David J. Kappos
*Director of the United States Patent and Trademark Office*